US010575583B2

(12) United States Patent
Stephens

(10) Patent No.: US 10,575,583 B2
(45) Date of Patent: Mar. 3, 2020

(54) PROTECTIVE FACE COVERING

(71) Applicant: Lee Stephens, Las Vegas, NV (US)

(72) Inventor: Lee Stephens, Las Vegas, NV (US)

(73) Assignee: Ghoststar, LLC, Panama City Beach, FL (US)

( * ) Notice: Subject to any disclaimer, the term of this patent is extended or adjusted under 35 U.S.C. 154(b) by 120 days.

(21) Appl. No.: 15/804,740

(22) Filed: Nov. 6, 2017

(65) Prior Publication Data

US 2018/0070668 A1 Mar. 15, 2018

Related U.S. Application Data

(63) Continuation-in-part of application No. 14/280,745, filed on May 19, 2014, now abandoned, which is a continuation-in-part of application No. 13/357,555, filed on Jan. 24, 2012, now abandoned.

(51) Int. Cl.

| | |
|---|---|
| ***A41D 13/00*** | (2006.01) |
| ***A42B 1/00*** | (2006.01) |
| ***A62B 18/08*** | (2006.01) |
| ***A62B 18/02*** | (2006.01) |
| ***A42B 3/20*** | (2006.01) |
| ***A42B 3/30*** | (2006.01) |
| ***A42B 3/28*** | (2006.01) |
| ***A42B 3/18*** | (2006.01) |
| *A41D 13/11* | (2006.01) |

(52) U.S. Cl.

CPC ..... *A42B 3/20* (2013.01); *A42B 3/18* (2013.01); *A42B 3/288* (2013.01); *A42B 3/30* (2013.01); *A41D 13/11* (2013.01); *A62B 18/08* (2013.01)

(58) Field of Classification Search

CPC .. A41D 13/11; A42B 3/18; A42B 3/20; A42B 3/288; A42B 3/30; A62B 18/02; A62B 18/08

See application file for complete search history.

(56) References Cited

U.S. PATENT DOCUMENTS

| | | | |
|---|---|---|---|
| 3,196,458 | A | 7/1965 | Keith |
| 4,250,577 | A | 2/1981 | Smith |
| 4,825,474 | A | 5/1989 | Edwards |
| 5,570,705 | A | 11/1996 | Burke |
| 5,600,855 | A | 2/1997 | Ramirez |
| 5,628,308 | A | 5/1997 | Harges, Jr. et al. |
| 5,699,792 | A | 12/1997 | Reese et al. |
| 5,704,063 | A | 1/1998 | Tilden |
| 5,884,336 | A | 3/1999 | Stout |
| 6,148,820 | A | 11/2000 | Herrin |
| 6,338,340 | B1 | 1/2002 | Finch et al. |
| 6,804,829 | B2 | 10/2004 | Crye et al. |

(Continued)

*Primary Examiner* — Jameson D Collier

(74) *Attorney, Agent, or Firm* — James M. Duncan, Esq.; Klein DeNatale Goldner

(57) ABSTRACT

An apparatus which may be used to protect a user's mouth, nose, chin, ears, and jaw from projectiles, direct impacts, air contaminants, and reduce concussive impact to the ears. Before air flowing into the apparatus is filtered by a filter member upstream of a mouthpiece, the air flow first passes through a plurality of conduits in a nose and protection member, where the nose and chin protection member is fabricated from an impact resistant material. Each of the conduits has a deflection member which changes the direction of the air flow. The user's exhalations do not flow back through the filter member but are rather redirected through side ports in the mouth piece.

18 Claims, 18 Drawing Sheets

(56) References Cited

U.S. PATENT DOCUMENTS

| | | | |
|---|---|---|---|
| 6,817,362 | B2 | 11/2004 | Gelinas et al. |
| 6,938,272 | B1 | 9/2005 | Brown |
| 6,941,949 | B2 | 9/2005 | Amante et al. |
| 7,237,550 | B1 | 7/2007 | Lin |
| 7,255,627 | B2 | 8/2007 | Bodnar et al. |
| 7,308,721 | B1 | 12/2007 | Rivera, Jr. |
| 2005/0172968 | A1 | 8/2005 | Hishida |
| 2007/0101996 | A1 | 5/2007 | Carstens |
| 2007/0192946 | A1 | 8/2007 | Wright |
| 2007/0266483 | A1 | 11/2007 | Probst |
| 2008/0127400 | A1 | 6/2008 | Dupuis |
| 2008/0223370 | A1 | 9/2008 | Kim |
| 2009/0014005 | A1 | 1/2009 | MacKinnon |
| 2009/0126064 | A1 | 5/2009 | Reaux |
| 2009/0320172 | A1 | 12/2009 | Slate et al. |
| 2010/0024826 | A1 | 2/2010 | Sullivan, Jr. |
| 2010/0205707 | A1 | 8/2010 | Mahan |
| 2010/0218304 | A1 | 9/2010 | Tonegawa |
| 2011/0030123 | A1 | 2/2011 | Palmeiri |
| 2011/0277769 | A1 | 11/2011 | Teng |
| 2013/0014316 | A1 | 1/2013 | Castro et al. |
| 2013/0319420 | A1 | 12/2013 | Danford |
| 2014/0196187 | A1 | 7/2014 | Beliveau |
| 2014/0196200 | A1 | 7/2014 | Beliveau |
| 2014/0317835 | A1 | 10/2014 | Mejia, Jr. |

PROTECTIVE FACE COVERING

RELATED APPLICATIONS

This application claims priority of U.S. patent application Ser. No. 13/357,555, filed Jan. 24, 2012 and U.S. patent application Ser. No. 14/280,745, each entitled "Protective Face Covering," which applications are incorporated herein by reference in their entireties.

BACKGROUND OF THE INVENTION

The present invention relates generally to a protective covering, and more specifically to a self-contained covering for protecting a user's mouth, nose, chin, ears, and jaw from projectiles, direct impacts, contaminants in the air, and loud noises. The present invention may be used in a variety of applications in which such protection is required, including combat situations, law enforcement, and operation of motorcycles and off-road vehicles.

Protective helmets and face masks have long been utilized by soldiers, police officers, firefighters and persons riding motorcycles and off-road vehicles. Helmets protect the head from injury through impact by projectiles or, in the case of motor vehicle operation, from contact with the road, ground, or other vehicles or riders in the event of an accident. Many such helmets include structures that extend over the entire head of the user, including the face, thereby shielding the eyes and reducing the risk of injury to any part of the head. However, these helmets are bulky, can be heavy and the interior of such helmets can become hot and uncomfortable when the user is engaged in strenuous activity, such as military, firefighting and law enforcement activities, and/or when ambient temperature increases.

Because of the drawback of bulky, stifling helmets, military personnel, fire fighters, law enforcement, and motor vehicle operators may settle for less than complete protection of their mouth, nose, chin, eyes, ears and jaws in order to avoid the discomfort inflicted by many of the available options. By way of example, many recreational motorcycle riders wear helmets that do not cover the entire head. The extent of the head that is covered varies according to the design of the helmet and ranges generally from those that leave the face exposed to those that extend primarily around the top of the head only. These helmets leave portions of the head exposed, including the mouth, nose, chin and jaw. These portions of the head are then subjected to an increased risk of injury in the event of an accident.

Further, for all of the above identified uses (i.e., military, law enforcement, recreational use), areas of the head may be injured by projectiles, blunt force trauma, flying rocks, dirt, dust, or other particles cast into the air by assailants, the environment or by other vehicles. Such helmets also leave portions of the face exposed to dirt, insects, and other airborne debris. In the case of military and law enforcement personnel, the use of personal weapons, explosives, and other tactical devices may result in injury to the ears resulting from the concussive impact of such devices.

Another issue which may arise is the fogging up of a face shield, goggles, glasses, or other eye protection utilized in combination with a face mask, particularly when the face mask includes breathing ports or openings. Exhalations through the nose or mouth can cause the face mask to cloud up.

Attempts have been made to remedy the above-described deficiencies. Such remedies may include providing a separate, detachable feature that covers additional portions of the face. One problem with this solution is that the extra protection is dependent upon having a helmet that will mate with the attachable portion. The attachable portion is of no value if a matching helmet is unavailable. Further, these additional portions that attach to existing helmets may not function without a full helmet. In some situations where full helmets are not required or not appropriate for a particular tactical situation, it may nevertheless be desirable to shield certain areas of the face, such as the mouth, ears and nose, with a protective covering which provides protection from some or all of the occurrences described above.

What is needed, therefore, is a self-contained protective covering that provides protection to the mouth, nose, ears, chin, and jaw, that is usable with a wide variety of helmets, or without a helmet, which filters incoming oxygen for the user, and which does not result in the fogging up of a face shield, goggles or other eye protection.

SUMMARY OF THE INVENTION

The present invention provides, in one aspect, a protective face covering which provides protection to a user's face, namely the user's mouth, nose, chin, ears and jaw. In one embodiment, the protective face covering has, in ordered arrangement from a position adjacent to the user's mouth and proceeding away from the user's face, a breathing piece, an air dispersing member, a filter member, a nose and chin protection member, and a mandibular-shaped outer member.

The breathing piece has an opening configured to fit over the mouth and nose of the user, where the opening is defined by a peripheral wall which seals around the user's mouth and nose. The air dispensing member has a perforated front wall disposed against the opening in the breathing piece. The filter member has an inward facing side and outside facing side, where the inward facing side is disposed against the perforated front wall of the air dispensing member. The nose and chin protection member has a back side and a front side with a plurality of openings extending from the back side to the front side. The outside facing side of the filter member is disposed against the back side of the nose and chin protection member.

The mandibular-shaped outer member is defined by a front piece and an integral left side member and an integral right side member. The mandibular-shaped outer member has an interior face and an exterior face, wherein the breathing piece, the air dispersing member, the filter member and the support member are encapsulated between the integral left side member and the integral right side member. The nose and protection member has a plurality of air conduits extending from the front side to the back side, where each air conduit has a deflection member such that a stream of air flowing from the front side to the back side impacts the deflection member as the stream of air flows from the front side to the back side, where a stream of air is accessible to the user by flowing through the filter member and through the perforated front wall to the user's mouth and nose. In other words, the flow path of air to the user is non-linear before passing through the filter.

Another embodiment of the invention has a fastening unit for attaching the apparatus about the head of a user. The fastening unit may have a first portion which attaches to the integral left side member of the mandibular-shaped outer member and a second portion which attaches to the integral right side member of the mandibular-shaped outer member. The attachment of the fastening unit to the mandibular-shaped outer member may be done with hook and loop fasteners, zippers, snap buttons, and similar devices which allow for removeable attachment. Alternatively, the fastening unit may be integral to the mandibular-shaped outer member, such that a user would don the apparatus by pulling it over his or her head.

The mandibular-shaped outer member or the fastening unit may have a left ear engagement surface and a right ear engagement surface, where the left ear engagement surface is configured to seal around the user's left ear and the right ear engagement surface is configured to seal around the user's right ear. The left ear engagement surface and the right ear engagement surface form a partial seal around the users' ears to reduce concussive impacts. Such concussive impacts may result from the various applications to which the apparatus may be utilized. For example, if the device is utilized by law enforcement, the concussive impacts may result from small arms fire, concussion grenades, and similar tactical devices. Likewise, if the device is utilized by recreational vehicle operators, the concussive impact may be generated by vehicles having a high decibel engine noise. Depending upon the particular application, the materials used to fabricate the mandibular-shaped outer member or the fastening unit may have an increased resistance to sound wave transmission. In addition, the sealing configuration of the left ear engagement surface and right ear engagement surface may be tighter to reduce sound transmission.

In another of the present invention, the mandibular-shaped outer member may comprise an ornamental or camouflage configuration.

In another aspect of the present invention, the filter associated with device may be a HEPA filter.

In another aspect of the present invention, the peripheral wall of the breathing piece may comprise a cushioning portion which seals around the user's face. The cushioning portion may be is a polyurethane foam.

In still another aspect of the present invention, the nose and chin protection member may be is constructed of graphite, fiberglass, para-amid synthetic fibers, polyethylene fibers, acrylonitrile butadiene styrene, carbon fiber, metals, metal alloys, or combinations of these.

In still another embodiment of the present invention, the nose and chin protection member may comprise an integral air filtering package, where the nose and chin protection member attaches to the mandibular-shaped outer member. The air filtering package has, in stacked facing relation, a breathing piece having an opening defined by a peripheral wall configured to encircle a user's mouth and nose, an air dispersing unit having a perforated front wall disposed against the opening in the breathing piece, a filter member sandwiched between the perforated front wall on an inside face of the filter and a support member on an outside face. With this configuration, inhalations of the user flow, in order, through the mandibular-shaped outer member, the support member, the filter member, the air dispersing unit and into the breathing piece. However, the user's exhalations flow, in order, out of the breathing piece, into the air dispersing unit and exiting the air dispersing unit through side vents of the air dispersing unit without the exhalations flowing through the filter member.

Other embodiments of the invention provides a protective face covering which may be utilized in combination with an upper head covering such as a helmet. The combination includes a protective shell sized and shaped to fit over the face of a user. The protective shell includes a protective airway covering extending only substantially over the nose and mouth of the user and not beyond, and having a plurality of openings for the passage of air. A first protective jaw covering extending from the protective airway covering substantially along the first side of the jaw to a first ear of the user, and not beyond. A second protective jaw covering extends from the protective airway covering substantially along the second side of the haw to a second ear of the user, and not beyond. A protective chin covering extends from the protective airway covering substantially beneath the chin of the user and not beyond. A fastener extends between the first protective jaw covering and the second protective jaw covering, passing along a lower portion of the back of the skull of the user. A helmet substantially covers an upper portion of the head of the user. The protective shell and fastener are not attached to the helmet.

DETAILED DESCRIPTION OF THE INVENTION

Figure 1:
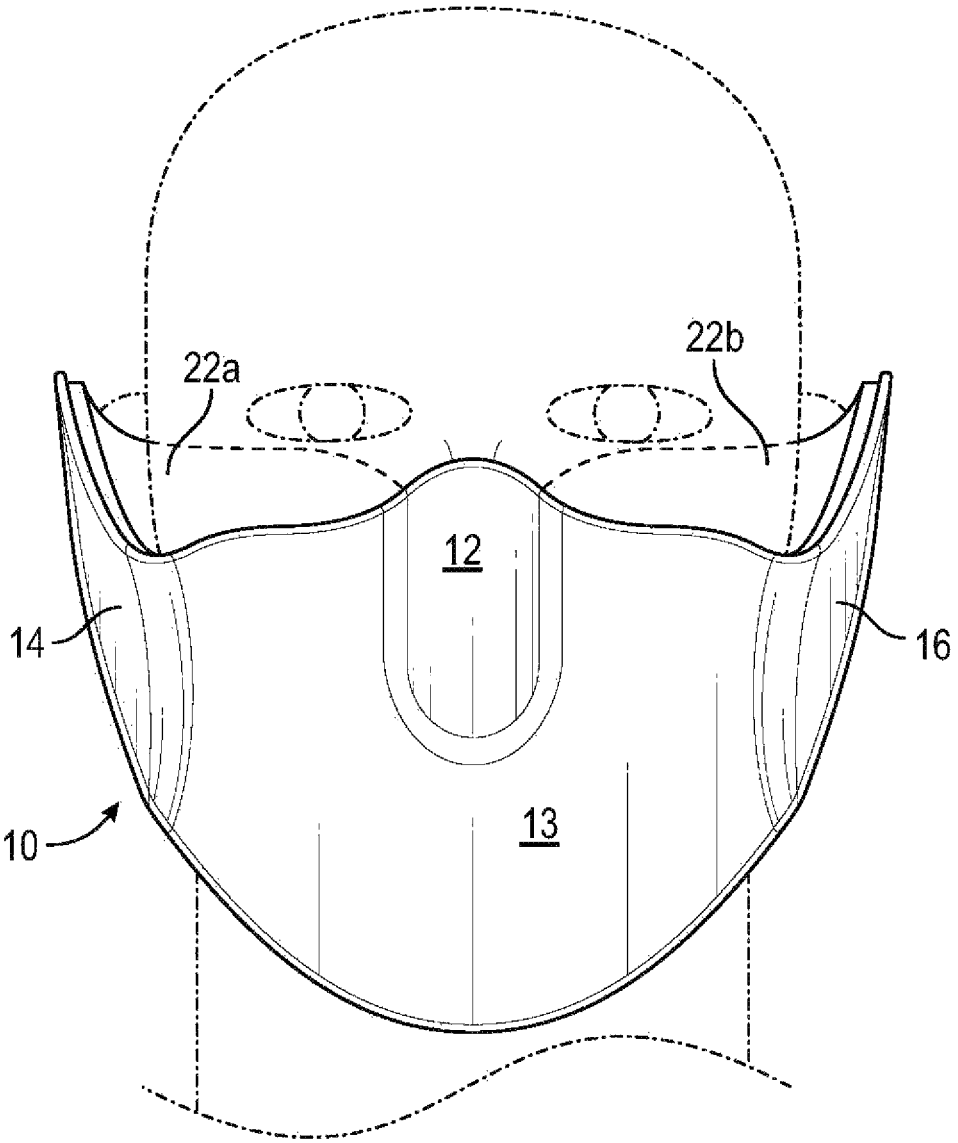
FIG. 1 is a front view of an embodiment of a protective face covering of the present invention, the protective face covering shown as worn over the face of a user.

The embodiments of the present invention described below are intended to be illustrative of the various principles and features of the present invention, and are not intended to limit the scope in the invention, except when such limitations are explicitly stated. In the course of describing the present invention, the phrases "interior-facing" and "exterior-facing" may be used to describe surfaces of various components of the present device. It is to be understood that when such phrases are used, the phrase "interior-facing" refers to a surface disposed toward the head of the user of the present invention, and "exterior-facing" refers to surfaces disposed toward the external environment, away from the head of the user.

The present invention provides a protective face covering sized and shaped to fit over the face of a user and to be held snugly thereto for a variety of situations in which such protection is desirable, which may include applications in combat operations, police actions, firefighting and motor vehicle operation. The protective face covering provides protection for portions of the face not covered by many traditional helmets, providing protection from injury through impact by projectiles or, in the case of motor vehicle operation, from contact with the road, ground, or other vehicles or riders in the event of an accident. and does not require attachment to an existing helmet structure in order to be used. The protective face covering may also be used independently of any other helmet or protective device, providing protection for only those areas shown in the drawings herewith, and not encompassing the head in the manner of a full helmet. The present invention also filters the air which passes through the invention to the user, providing a non-linear flow path from the exterior of the apparatus to the interior. Exhalations do not pass through the filter, but are vented in a manner which prevents fogging up of a user's eye wear or face shield. The air venting further equalizes pressure and thereby prevents pressure build-up around the user's ears which might exacerbate concussive injury.

Figure 12:
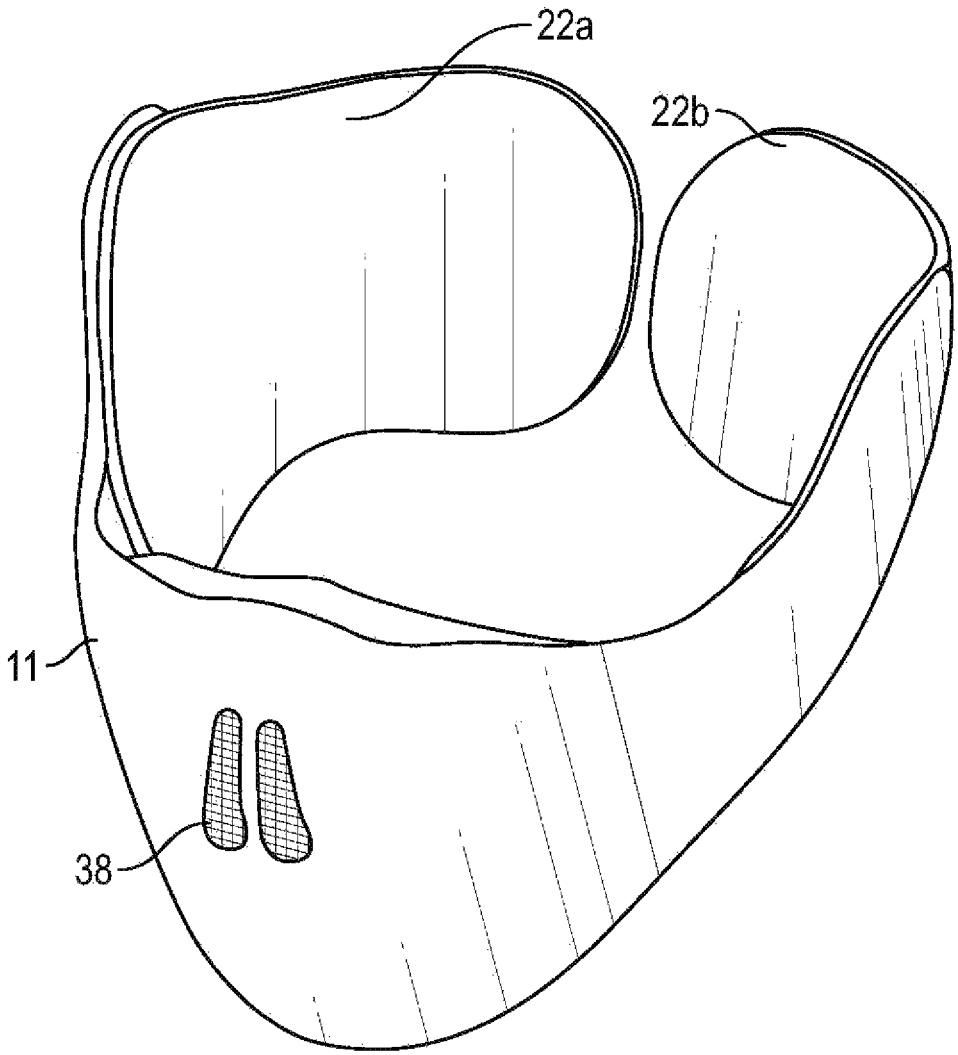
FIG. 12 is a front and side perspective view of an embodiment of a protective face covering of the present invention.
Figure 16A:
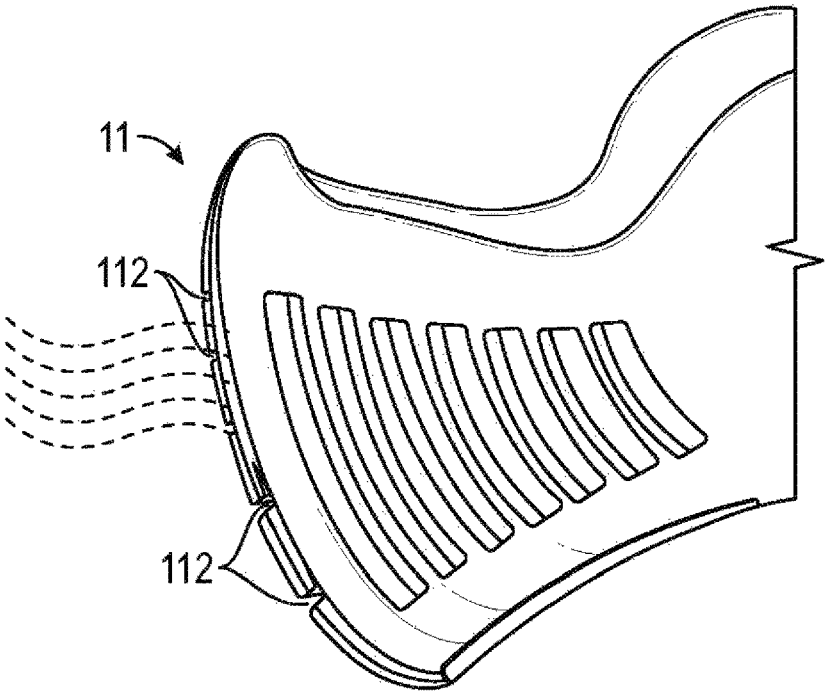
FIG. 16*a* schematically depicts the flow of an inhalation flowing into an embodiment of the present invention.
Figure 16B:
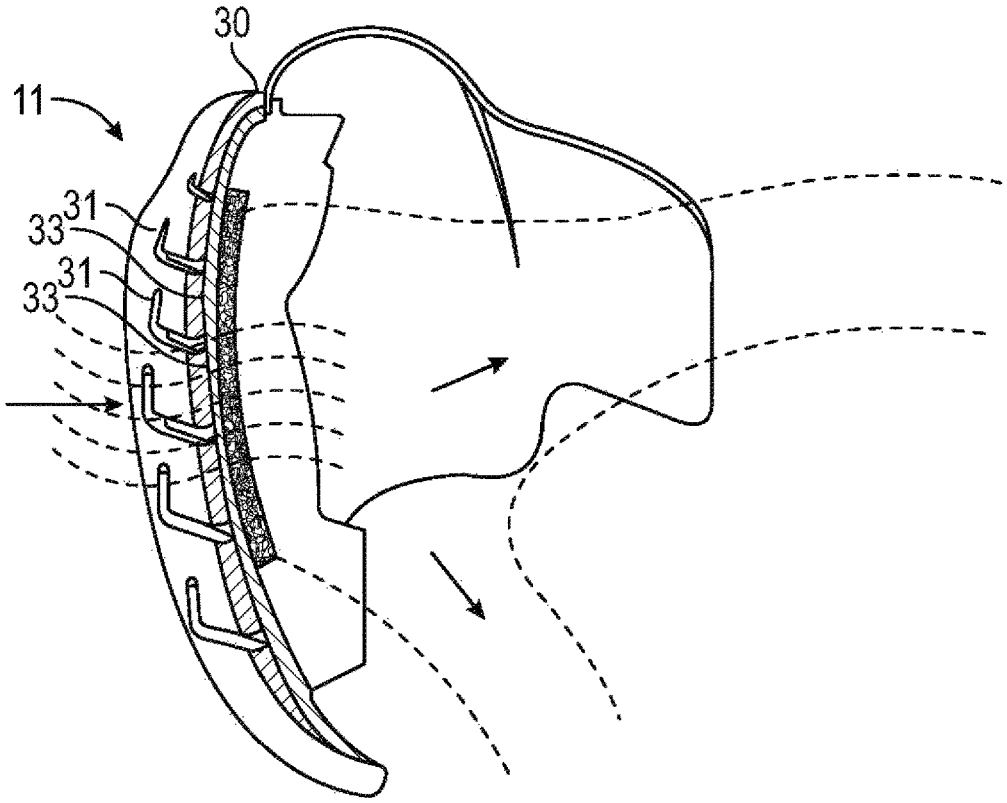
FIG. 16*b* schematically depicts the non-linear flow path of an inhalation through an embodiment of the present invention.

Turning now to the drawings, wherein like numerals indicate like parts, FIG. 1 provides a perspective view of one exemplary embodiment of the present invention. The numeral 10 refers generally to the various embodiments of the protective face covering of the present invention. Protective face covering 10 includes generally a mandibular-shaped outer member 11 which may include a protected airway 12 as depicted in FIG. 1 which allows air passage into the interior of the mask. Alternatively, air passage may be directed through protected nasal openings 38 as shown in FIG. 12, or through slots 112 as depicted in FIGS. 16*a*-16*b*.

Figure 2:
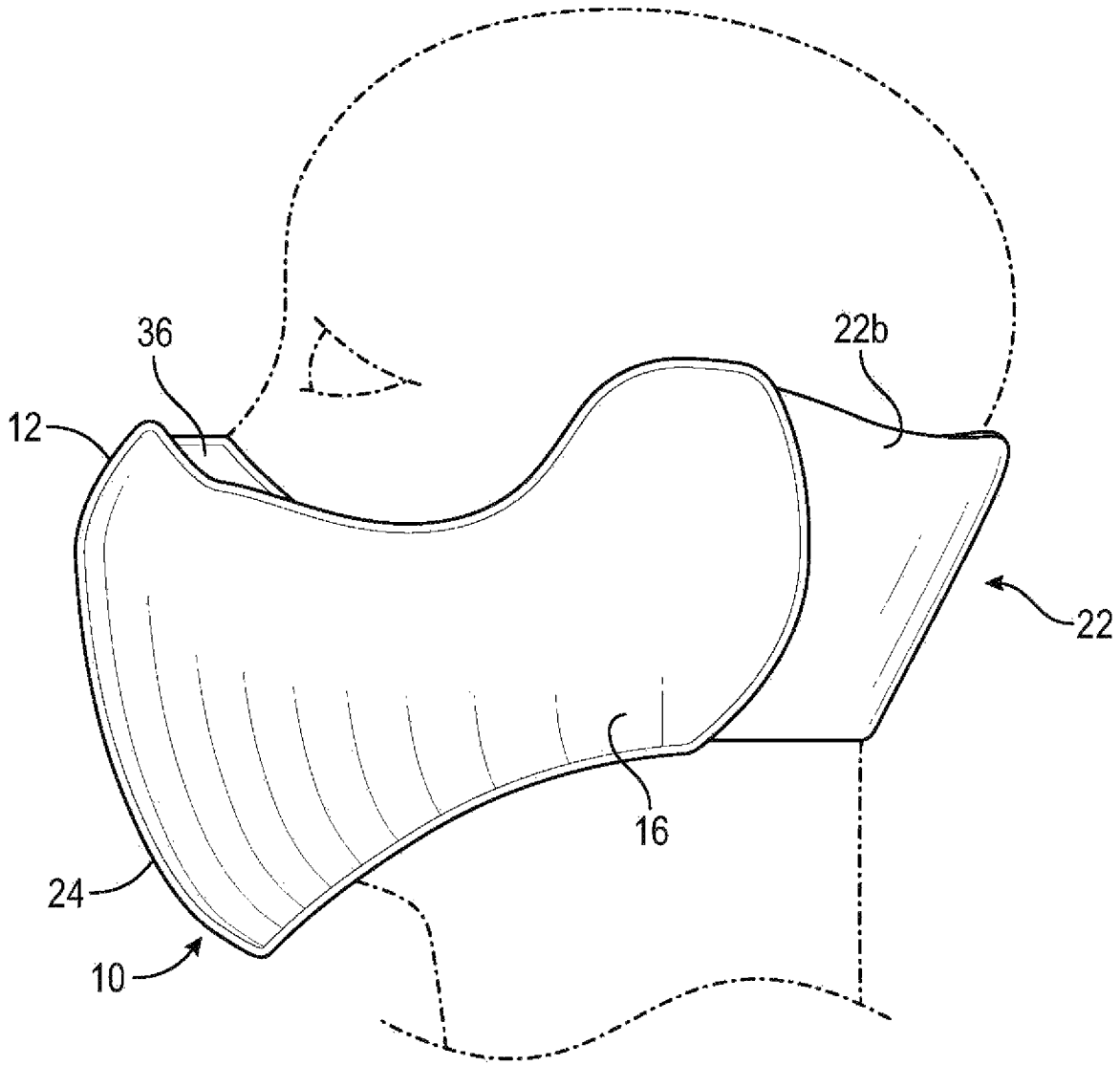
FIG. 2 is a side view of one embodiment of a protective face covering of the present invention, the protective face covering shown as worn over the face of a user.
Figure 2A:
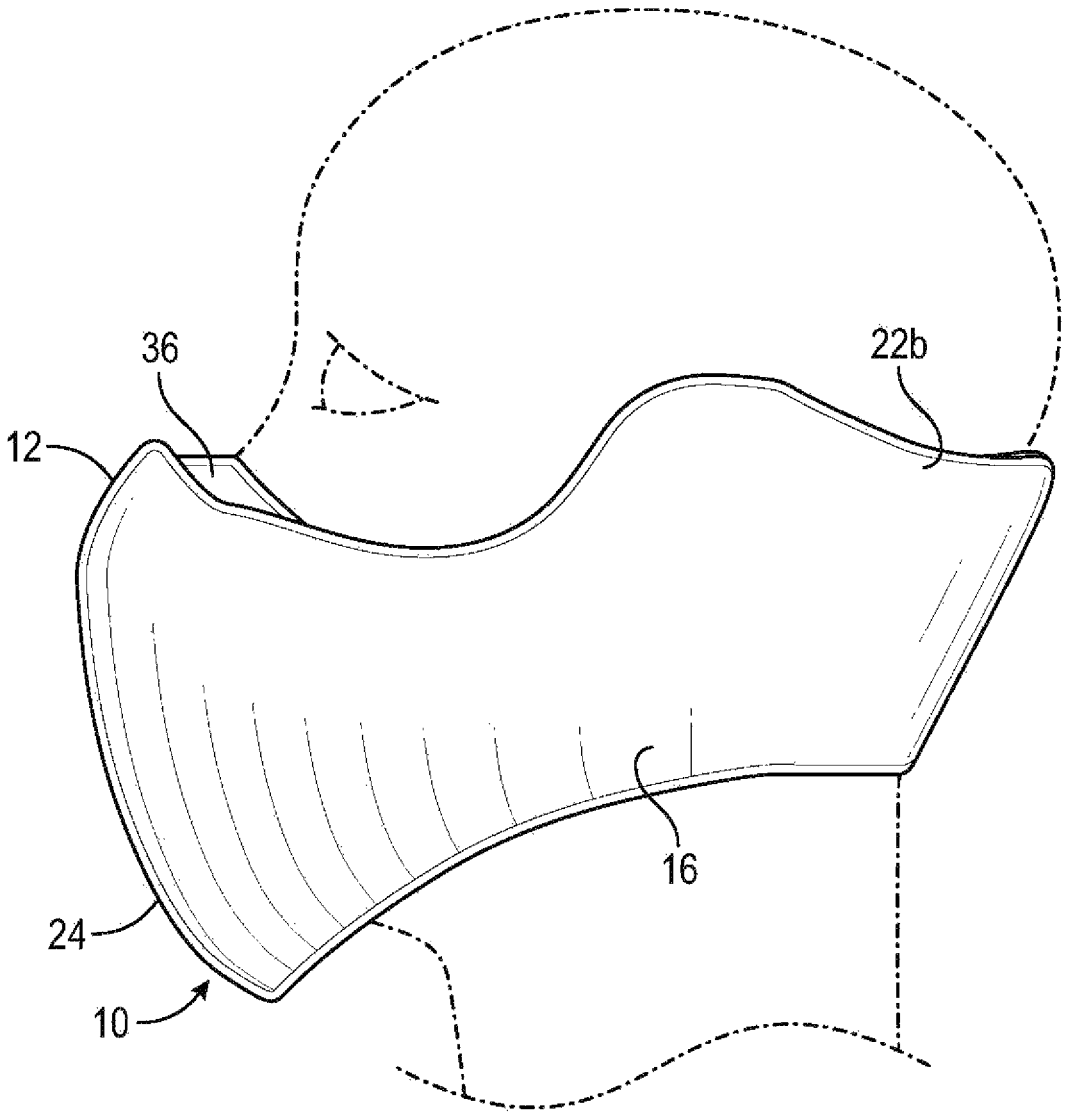
FIG. 2*a* a side view of alternative embodiment from FIG. 2, wherein the fastening unit is integral to the mandibular-shaped outer member.
Figure 3:
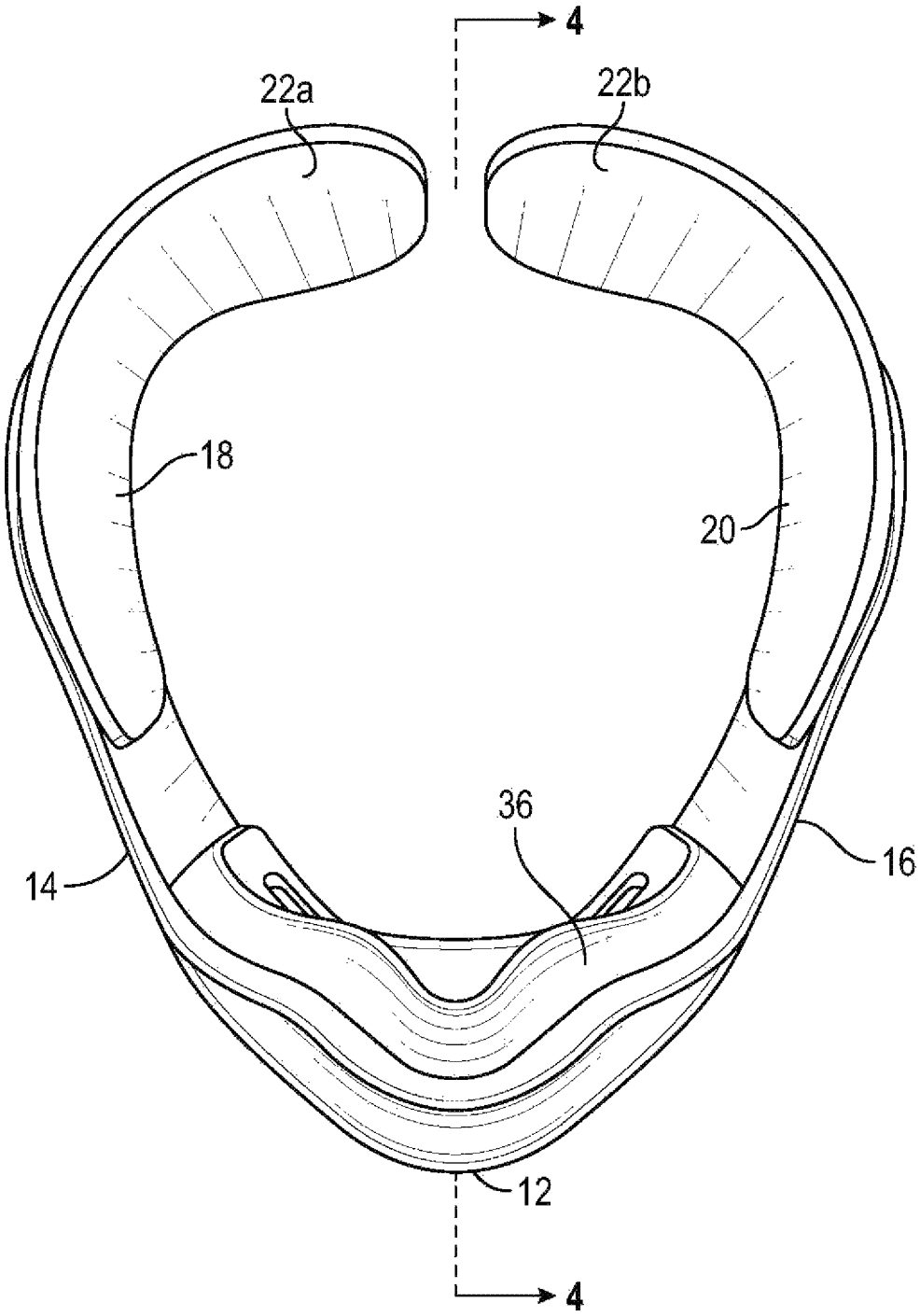
FIG. 3 is a top view of one embodiment of a protective face covering of the present invention.
Figure 4:
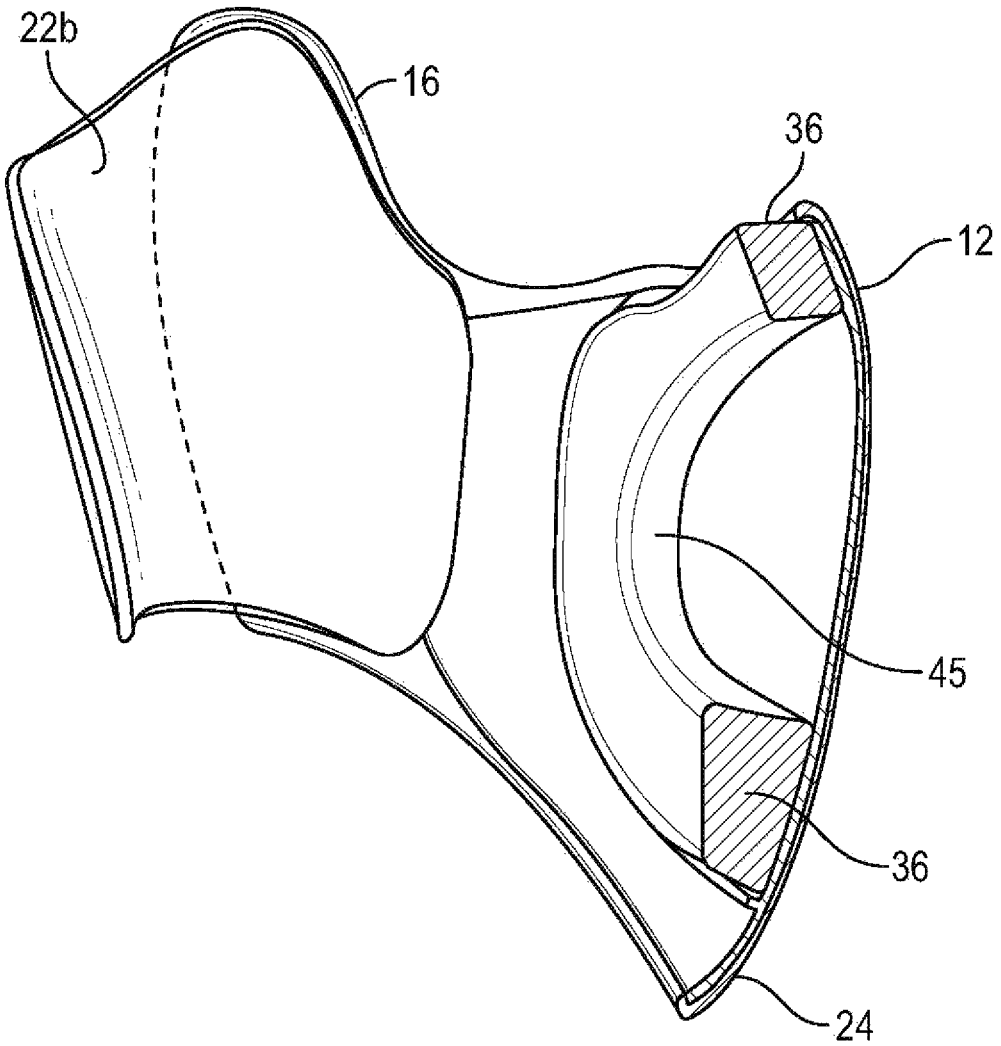
FIG. 4 is a cross-sectional view of one embodiment of a protective face covering of the present invention, taken along line 4 of FIG. 3.

Mandibular-shaped outer member 11 further comprises a front piece 13, an integral right side member 14 and an integral left side member 16. Protective face covering 10 may also comprise a fastening unit 22, which may comprise a first portion 22*a* which may attach to the integral right side member 14 and a second portion 22*b* which may attach to the integral left side member 16. First portion 22*a* may attach to integral right side member 14 and second portion 22*b* may attach to integral left side member 16 by hook-and-loop fasteners, zippers, snap-buttons or the like. As shown in FIG. 2, the fastening unit 22 encircles a back portion of the head of a user. Alternatively, as depicted in FIG. 2*a*, fastening unit 22 may be integral to mandibular-shaped outer member 11. A user would don this embodiment by pulling it over his or her head like a pullover garment.

Figure 5:
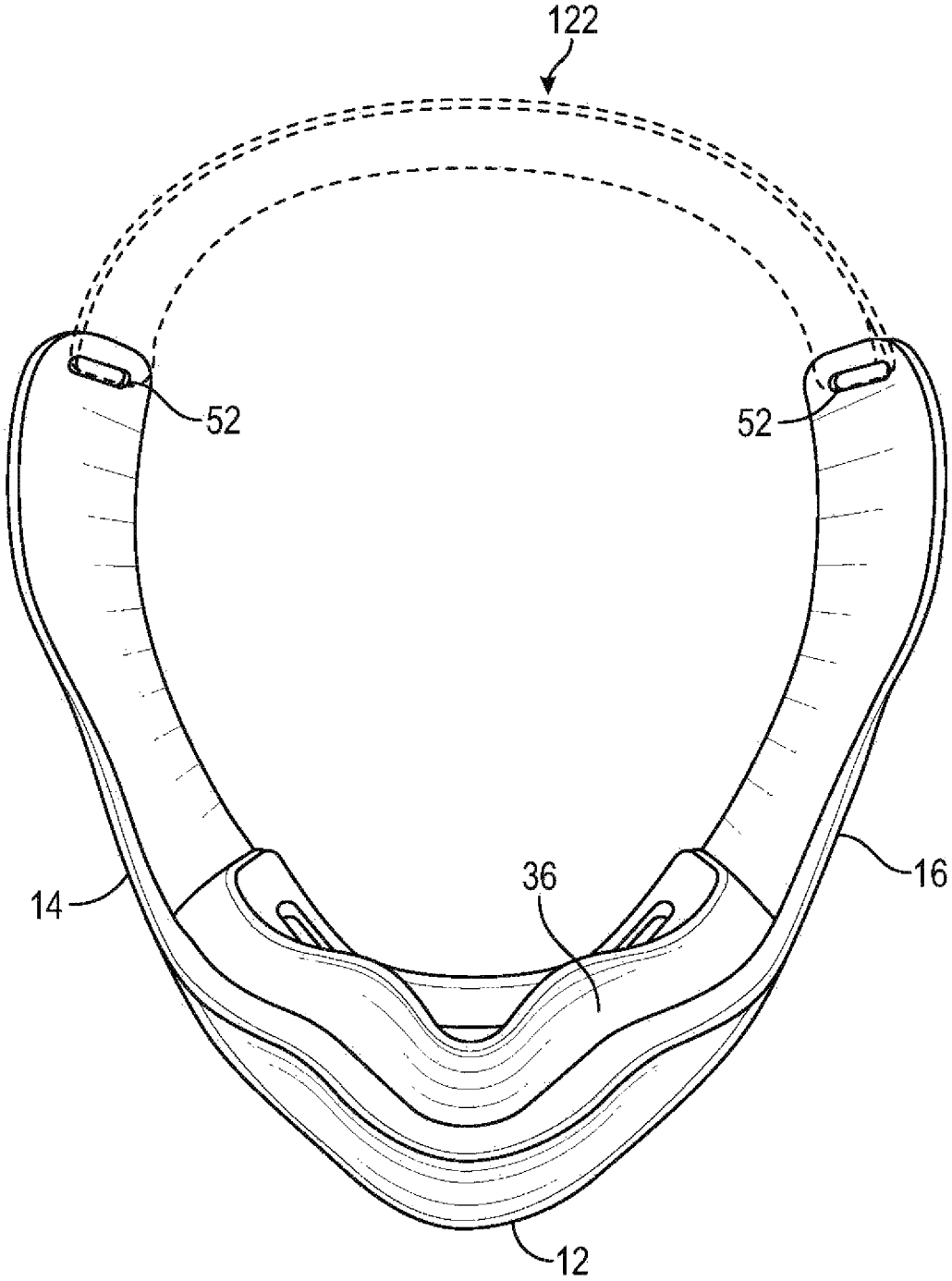
FIG. 5 is a top view of an alternative embodiment of a protective face covering of the present invention.
Figure 6:
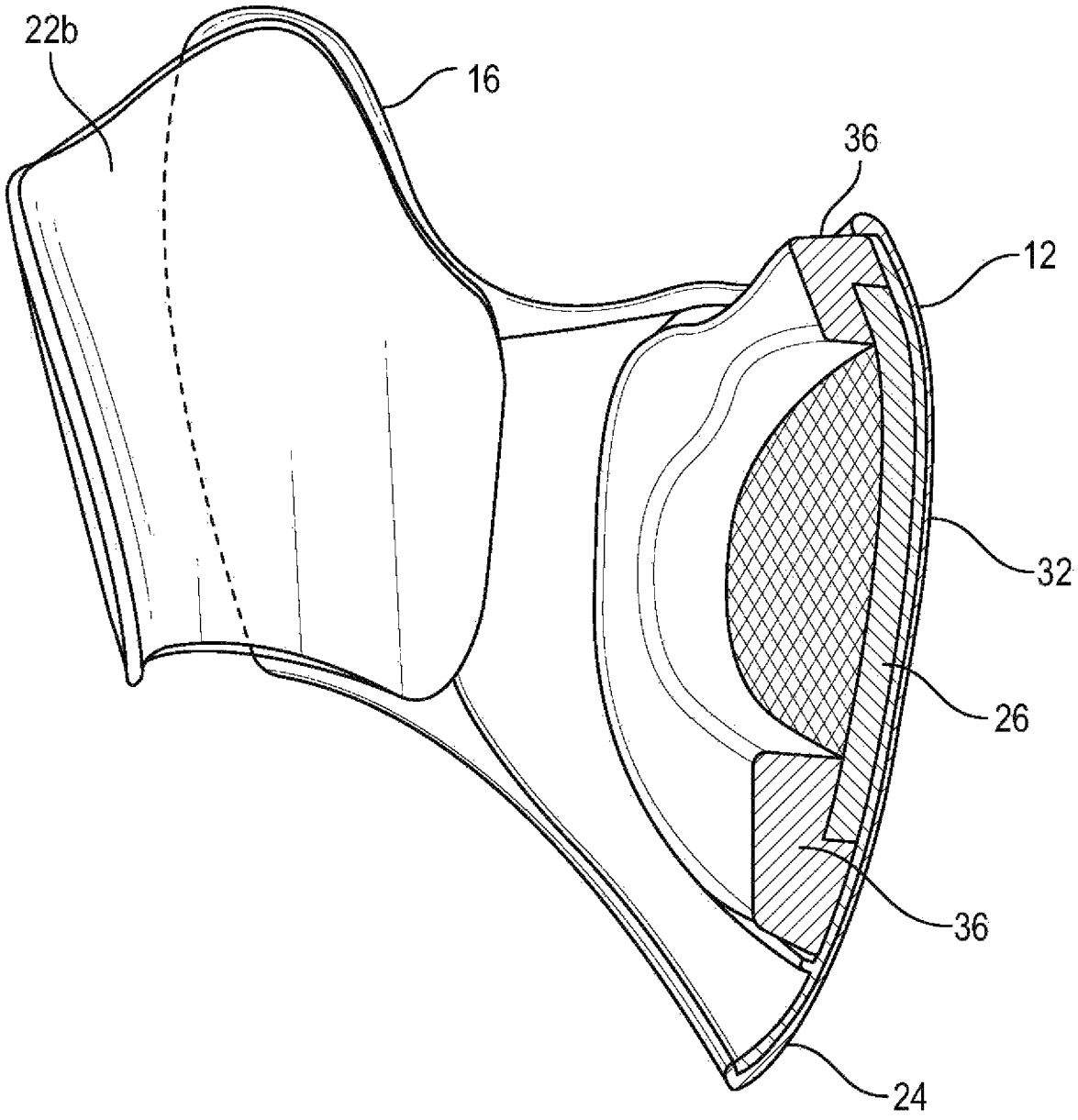
FIG. 6 is a sectional view of another embodiment of a protective face covering of the present invention.

FIG. 5 depicts an alternative embodiment of a fastening unit 122 which attaches to integral right side member 14 and an integral left side member 16 by clip members 52.

The first portion 22*a* of the fastening unit 22 may comprise a right ear engagement surface 18 and the second portion 22*b* may comprise a left ear engagement surface 20. The right ear engagement surface 18 is configured to seal around the user's right ear and reduce concussive impacts and the left ear engagement surface 20 is configured to seal around the user's left ear and reduce concussive impacts. The material used for right ear engagement surface 18 and left ear engagement surface 20, as well as the sealing configuration around each of the user's ears may be modified according to the particular intended application of the protective face covering 10, and the expected sound wave exposure related to the application.

The other components of the protective face covering 10 are, in ordered arrangement beginning a position adjacent to the user's face and moving outwardly therefrom, include a breathing piece 36, an air dispersing member 34, a filter member 26, and a nose and chin protection member 30. Filter member 26 is sandwiched between the air dispersing member 34 to the inside and the nose and chin protection member 30 to the outside. Filter member 26 may be any suitable filtering structure or material, ranging from a portion of cloth or other material, to a sponge-like material, to a HEPA filter or other more advanced filtration system. The precise nature of filter 26 is dictated by the degree of filtration of air desired to be achieved by a given embodiment of the present invention. The breathing piece 36 has an opening 37 which is configured to fit over the mouth and nose of the user, where the opening is defined by a peripheral wall 39 which seals around the mouth and nose of the user. Air dispersing member 34 has a perforated front wall 35 which is disposed in facing relation with opening 37.

Nose and chin protection member 30 has a plurality of openings 31, described in greater detail below, which extend from the front side to the back side, where the plurality of openings provide air flow to filter 26. Nose and chin protection member 30 is fabricated from impact resistant materials and provides the primary protection to a user's mouth, nose and chin. Such materials will be readily apparent to one of ordinary skill in the art upon reading this disclosure. Exemplary materials that are suitable for use for the nose and chin protection member 30 are carbon fiber, graphite, metals, metal alloys, fiberglass, and para-amid synthetic fibers (such as KEVLAR®). Other components for the protective face covering 10 are polyethylene fibers (such as SPECTRA®), acrylonitrile butadiene styrene (ABS), nylon, lexan, and combinations of these. The materials used to construct the present device may vary based on a given use for the present device. For military applications, for example, the materials used to construct the present device may be chosen to withstand or provide some protection from blasts, shock, or projectile impacts such as from a bullet. Embodiments of the present device intended for use in extreme weather conditions may be fabricated from materials such that the face of the user of the device is protected and/or insulated against the elements.

The breathing piece 36, the air dispersing member 34, the filter member 26, and the nose and chin protection member 30 are encapsulated between the integral right side member 14 and the integral left side member 16. As best shown in FIG. 16A, the plurality of openings 31 in nose and chin protection member 30 are air conduits which extend from the front side of the nose and chin protection member to the back side, where each opening has a deflection member 33 such that a stream of air flowing from the front side to the back side impacts the deflection member as the stream of air flows from the front side to the back side, the stream of air thereafter accessible to the user by flowing through the filter member 26 and through the perforated front wall 35 to the user's mouth and nose. Breathing piece 36 may have cushioned portion constructed from foam or other material, where the cushioned portion has an extended perimeter that contacts the face of a user of protective face covering 10. Breathing piece 36 forms a seal around the nose and mouth of the user to prevent dust, insects, and other debris from entering between protective face covering 10 and the user's face.

Figure 7:
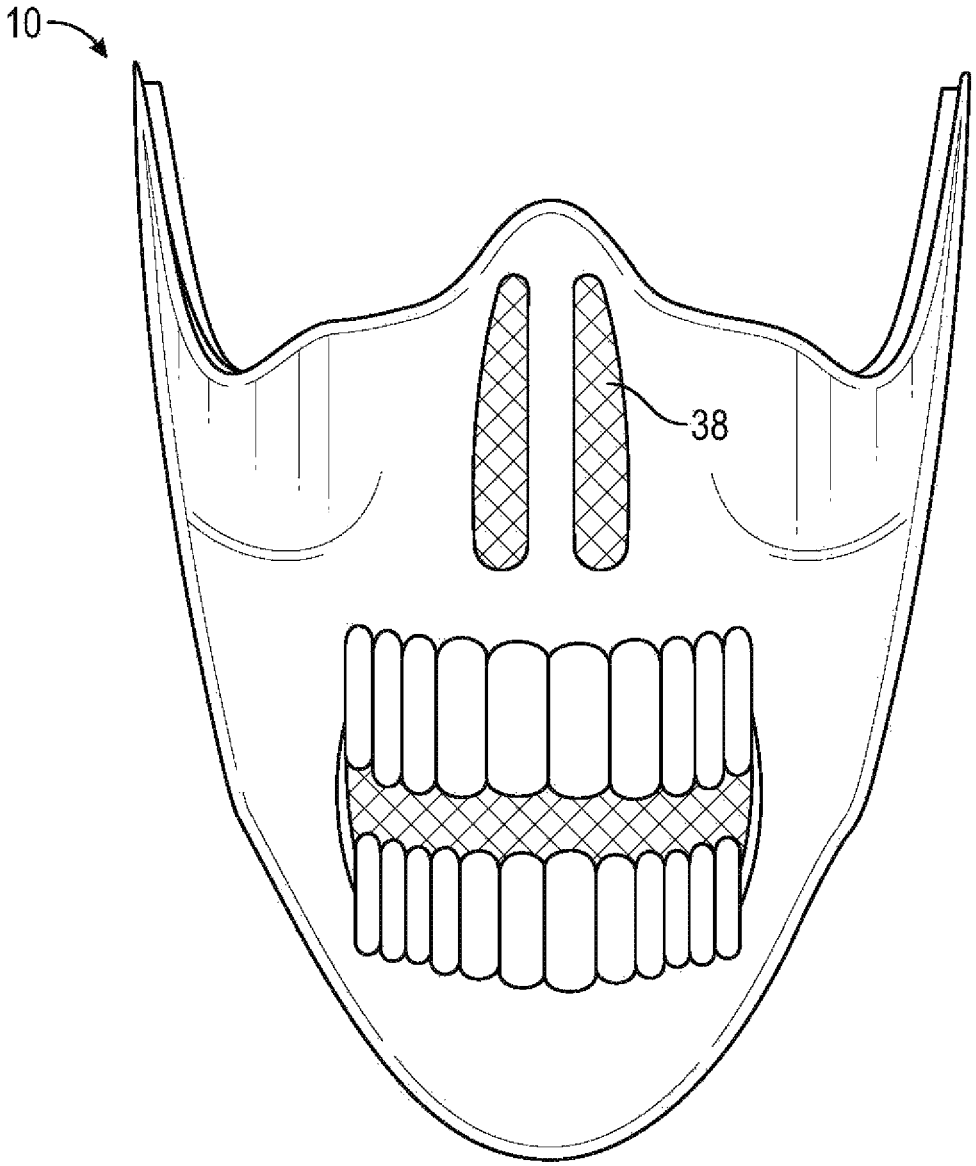
FIG. 7 is a front view of an alternative embodiment of a mandibular-shaped outer member of the present invention showing an ornamental feature thereof. Alternatively, the mandibular-shaped outer member may be camouflaged or fabricated of a non-reflecting material as required for a particular tactical situation.

Embodiments of the disclosed protective face covering 10 may also have a mesh member 32 disposed between the nose and chin protection member 30 and the mandibular-shaped outer member 11. Mesh member 32 may be fabricated from stainless steel, although any suitable material may be used. It is contemplated that mesh member 32 may provide some initial filtering of large particulate matter from an air stream passing through protective face covering 10, and that mesh member 32 may also provide an aesthetic or ornamental feature in that portions of mesh member 32 may be visible from the outside of protective face covering 10 through nasal opening(s) 38 and/or mouth opening(s) 40 as indicated in FIGS. 7 and 12.

It should be noted that the various portions of protective face covering 10 described herein cover just those portions of the user's face described herein and shown in the drawings, either in whole or in part. As such, protective face covering 10 as described herein, in addition to other uses, may be utilized with existing helmets that leave those portions of the user's face exposed, but without interfering with the wearing or use of the existing helmet or head covering.

Figure 15:
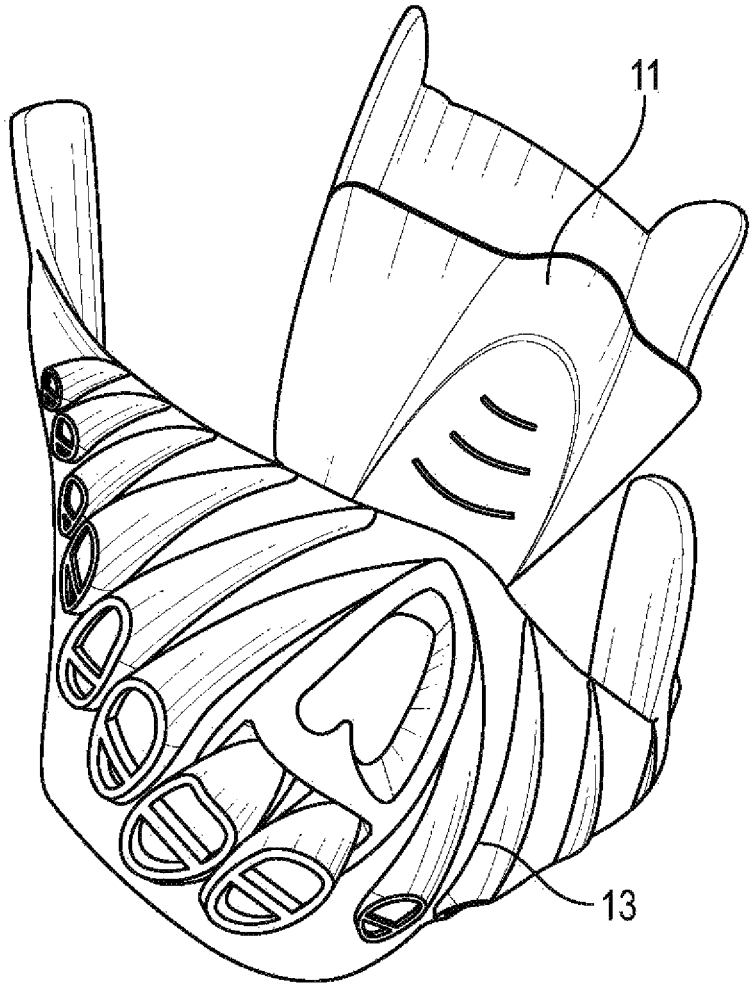
FIG. 15 is a perspective view of an embodiment of the protective face covering showing how the mandibular-shaped outer member of the present invention may have ornamental features.

In some embodiments of the present invention, protective face covering 10 may an ornamental feature associated therewith. Mandibular-shaped outer member 11 may be molded, shaped, or otherwise sculpted to provide the desired ornamental feature or camouflage, as suggested in FIGS. 7, 12 and 15.

Protective airway covering 12 includes one or more openings to allow air to pass therethrough, where the air is provided in a non-linear flow to the interior of the mask. This may be accomplished through the use of deflection members 33 described above in either the mandibular-shaped outer member 11 or in the nose and chin protection member 30.

Figure 9:
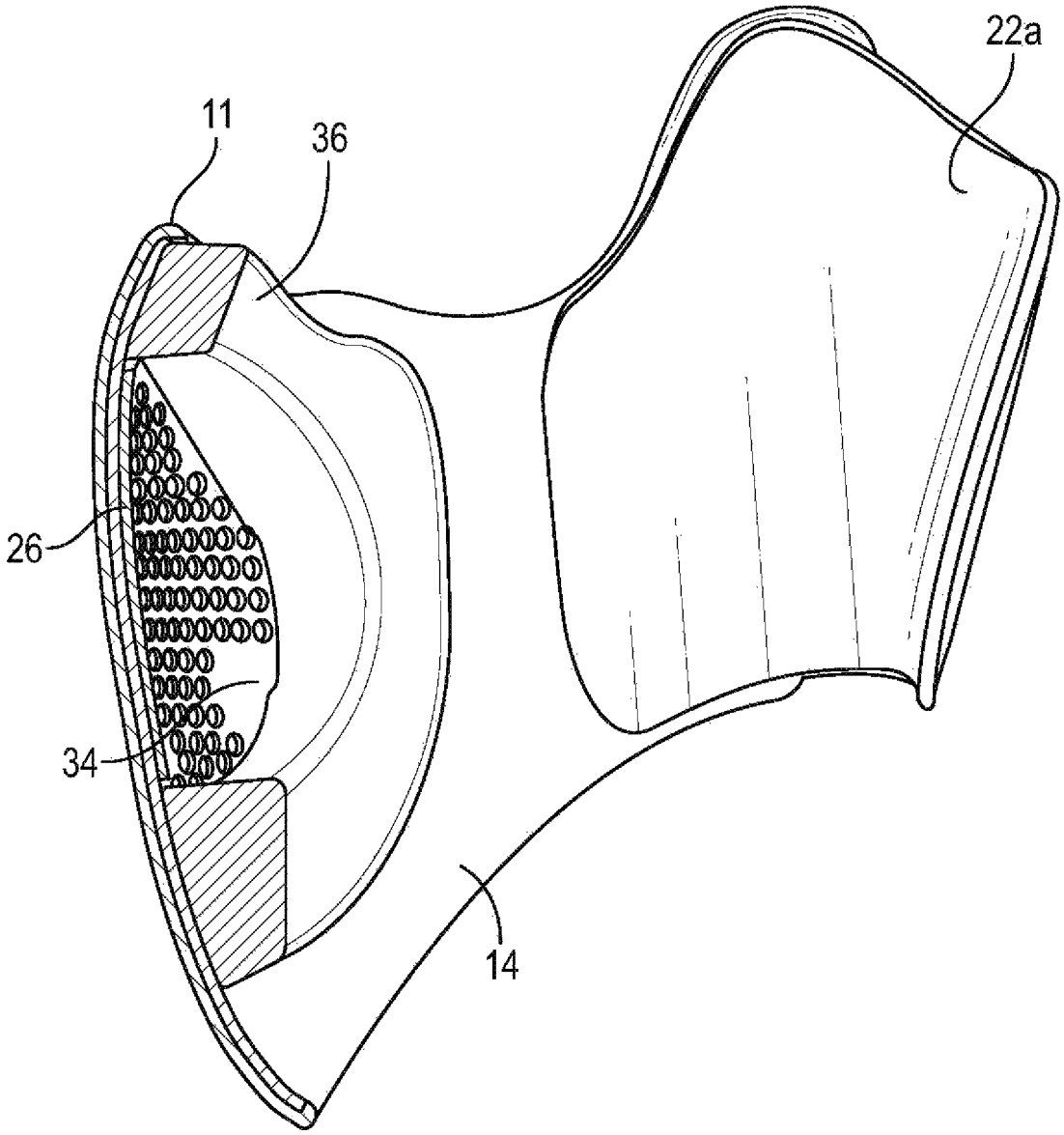
FIG. 9 is a sectional view of a portion of a protective face covering of the present invention.
Figure 10:
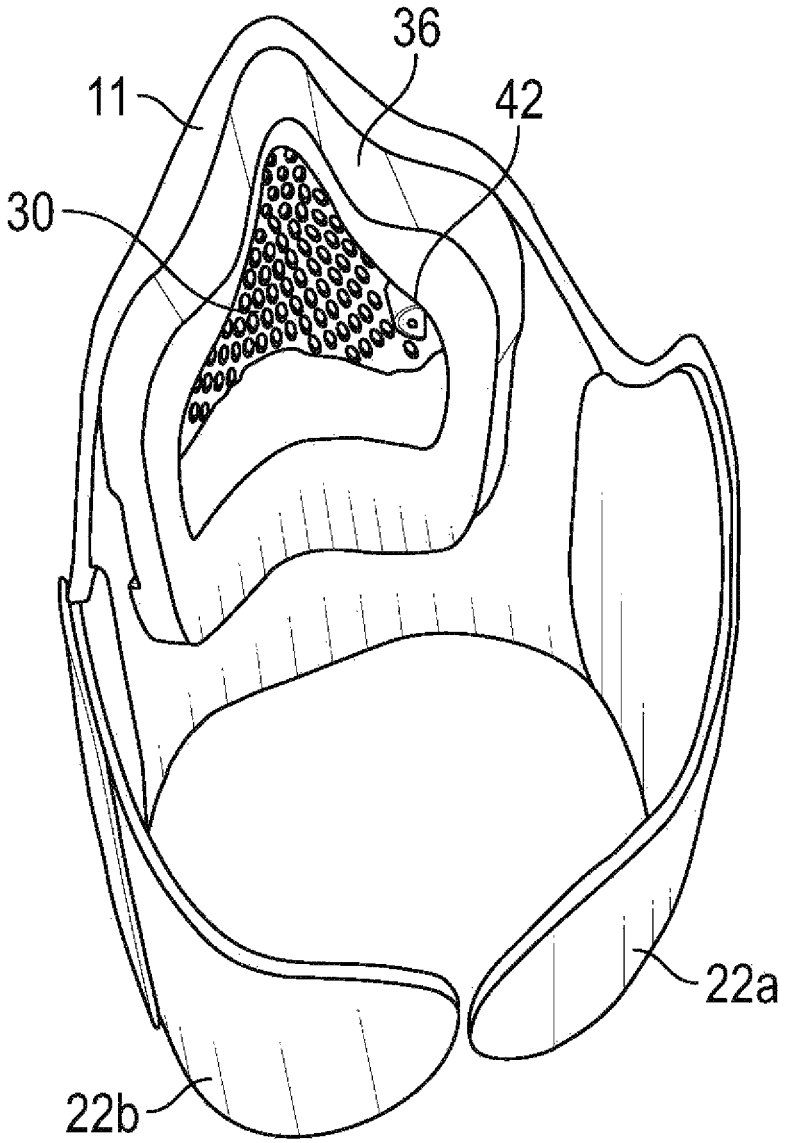
FIG. 10 is a top perspective view of an embodiment of a protective face covering of the present invention.
Figure 11:
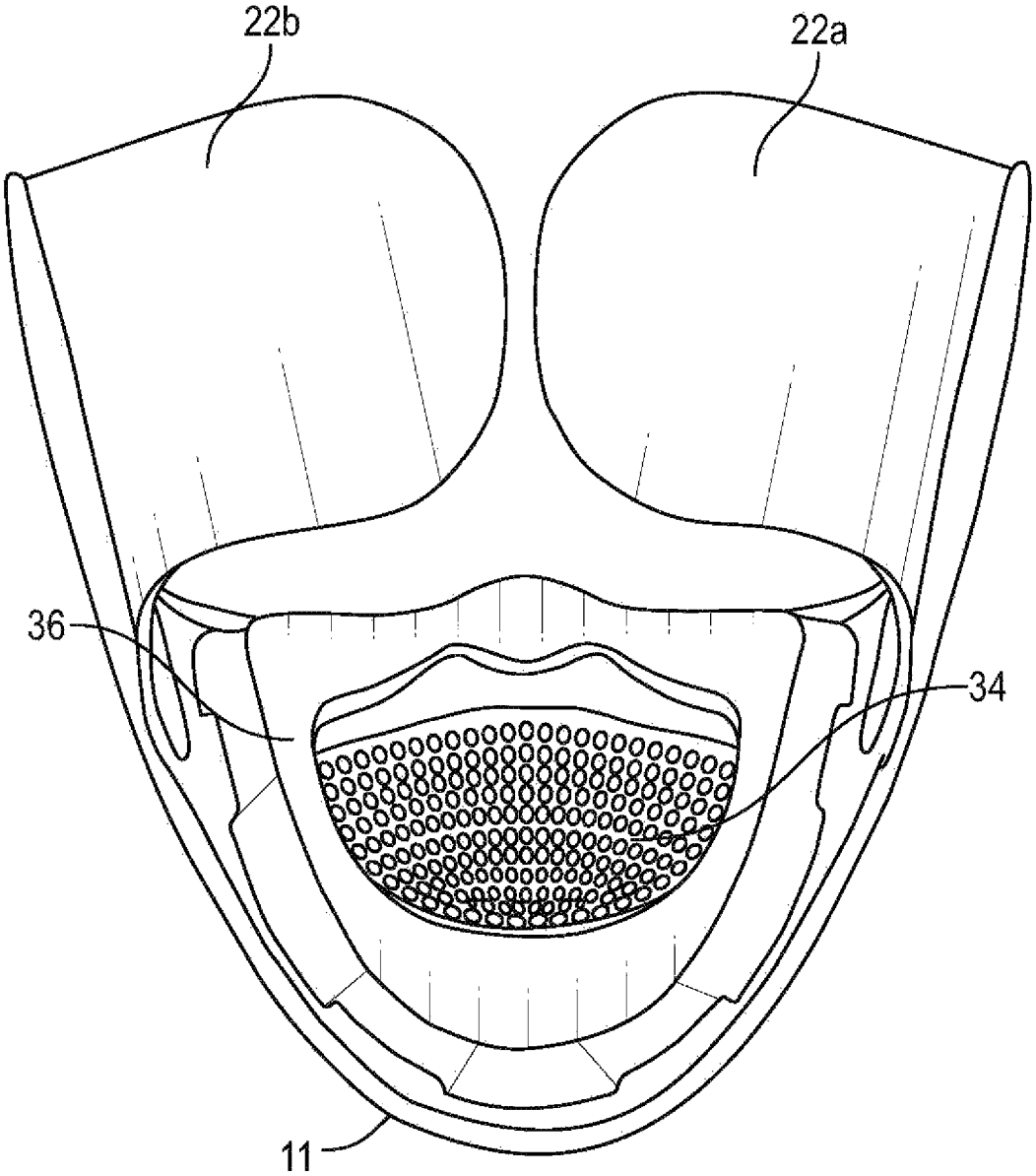
FIG. 11 is a bottom view of an embodiment of a protective face covering of the present invention.

FIG. 9 is a sectional view of an embodiment of the protective face covering 10. The cross-sectional view shows the relative positioning of each of the components of this embodiment of the invention described above. Mandibular-shaped outer member 11 is shown forming the outermost layer of the front portion of the device. Then, moving inward, is shown mesh member 32, nose and chin protection member support 30, filter member 26, air dispensing member 34, and breathing piece 36. Also shown is fastening unit 22.

Figure 8:
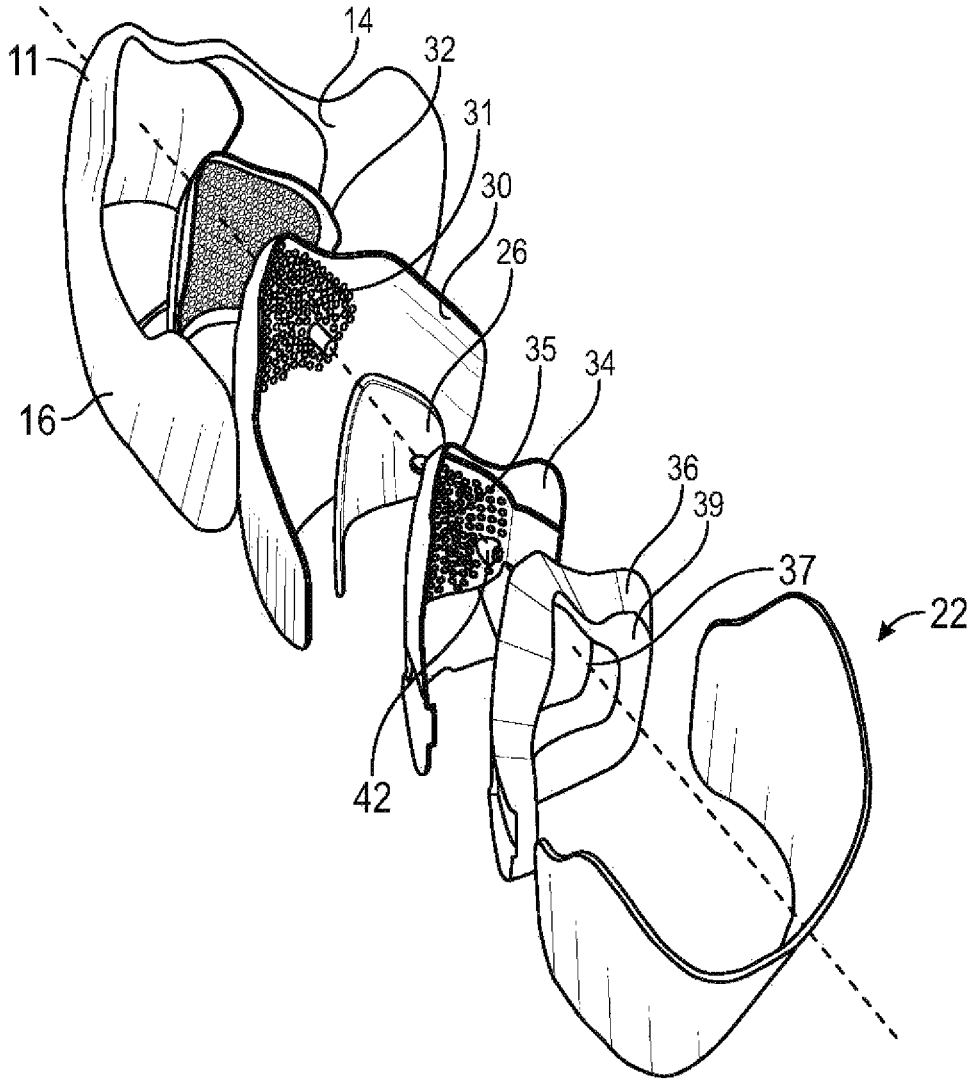
FIG. 8 is an exploded view of one embodiment of a protective face covering of the present invention.

In some embodiments of the present invention, breathing piece 36 and air dispensing member 34 may be provided as a separate, removable portion of the protective face covering. This allows a user to wash breathing piece 36 when necessary, or to replace breathing piece 36 and air dispensing member 34 when necessary or desired. Breathing piece 36 may be fixedly attached to air dispensing member 34, such as through the use of an adhesive or glue, and air dispenser 34 may include includes at least one fastener for affixing the air dispenser to the protective face covering 10. The fastener may be a screw, for example, passing through reinforced aperture 42 shown in FIG. 8, or may be any other suitable fastener.

In some embodiments of the present invention, a communications link may be provided, such as, for example, by providing a microphone and speaker embedded in the present device so that a wearer of the present device may communicate to others while wearing the device. Such a communications device preferably operates using radio transmission, and may be used for law enforcement, public safety, military applications, or any other situation in which the user of the present device desires to remain in contact with others. The radio communications may be short-range or long-range, and are preferably full-duplex devices, though it is contemplated that half-duplex devices may also be used. In one embodiment of the invention, the communications link of the present device transmits via a standard cellular telephone network.

Figure 13:
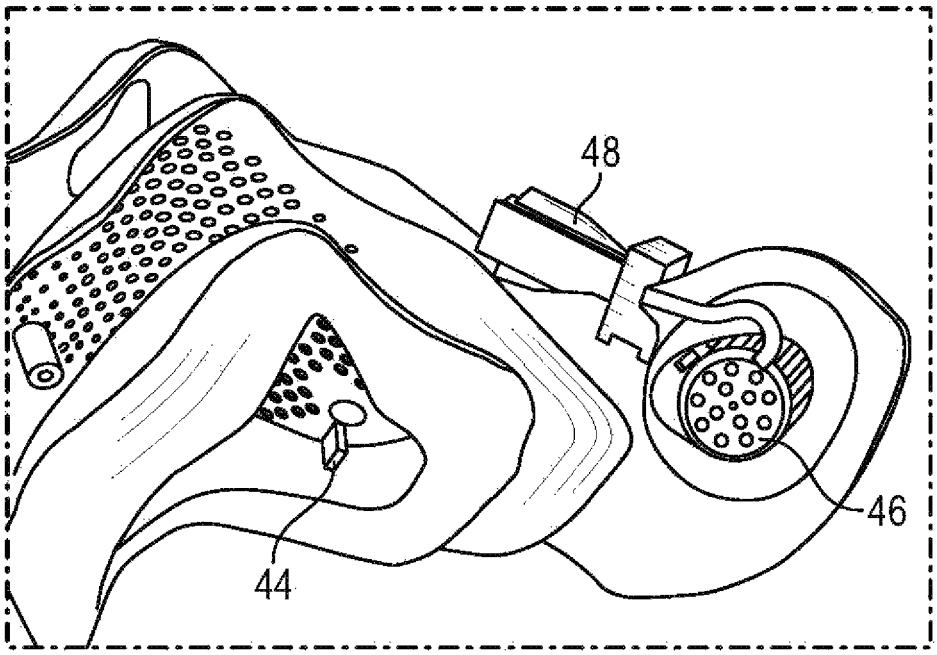
FIG. 13 is a detailed view of a portion of an embodiment of the present invention, the embodiment including a communications system.
Figure 14:
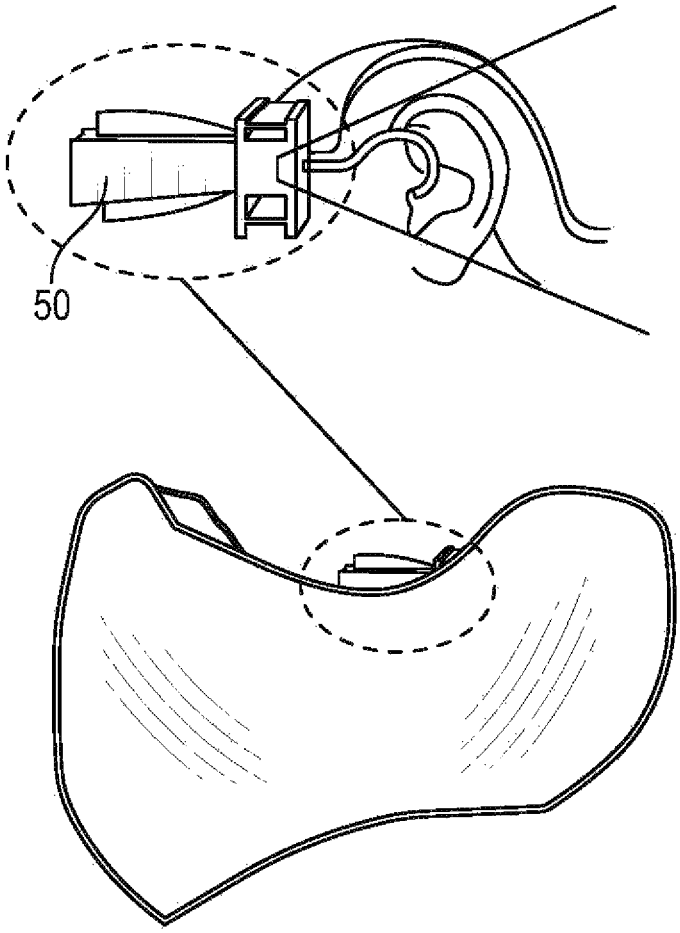
FIG. 14 is a detailed view of a communications element which may be used in various embodiments of the present invention.

FIG. 13 shows one embodiment of protective face covering 10 that includes a built-in microphone 44, ear phone 46, and camera 48. Camera 48 may be associated with a recording device for recording events taking place around the user of protective face covering 10. Microphone 44 may also be associated with the recording device, and the recording device may also be adapted to record incoming communications from other users. FIG. 14 shows an alternative embodiment of protective face covering 10 wherein a camera and ear phone are contained within a single housing 50. In some embodiments of the present invention, housing 50 may also include a microphone.

Figure 17A:
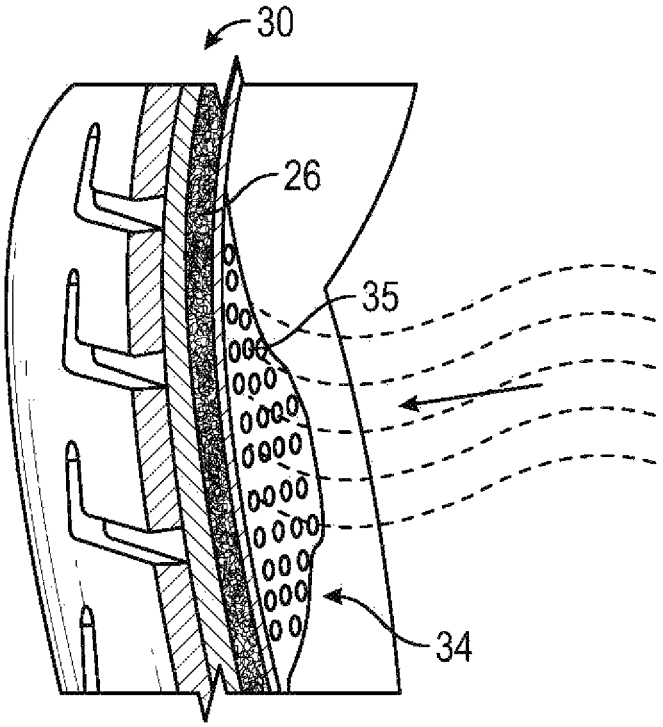
FIG. 17*a* schematically depicts the flow of an exhalation flowing into the nose and mouthpiece of an embodiment of the present invention.
Figure 17B:
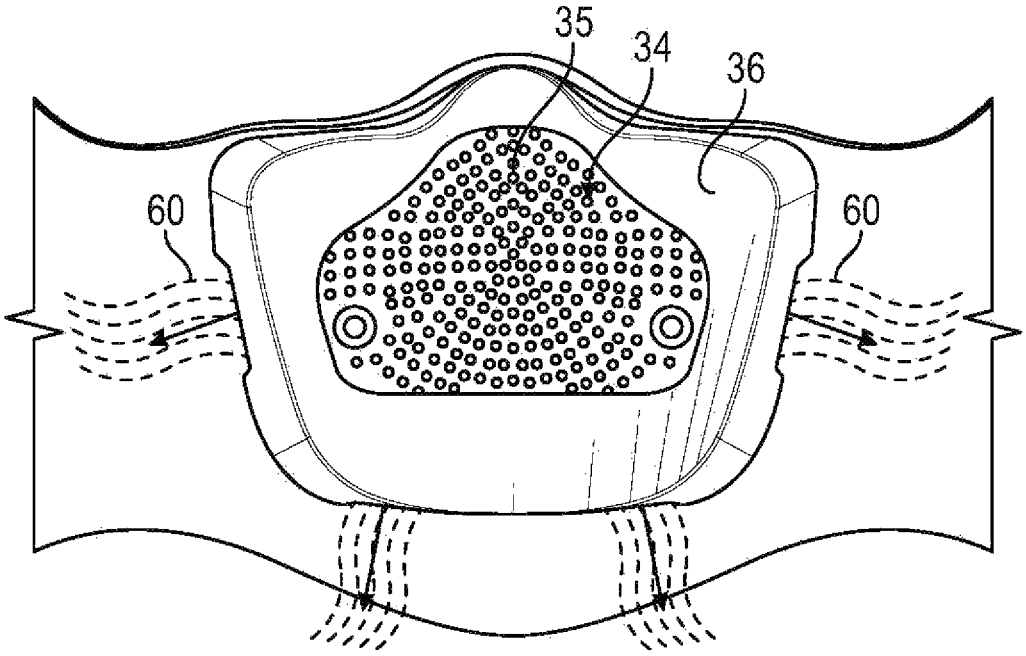
FIG. 17*b* schematically depicts how an exhalation is redirected to flow out through side vents in the nose and mouthpiece of the present invention.

FIGS. 16A and 16B illustrate the air flow provided when a user inhales through the protective face covering 10. The user's inhalations flow, in order, through the mandibular-shaped outer member 11, nose and chin protection member 30 which acts as a support member for the filter, the filter member 26, the air dispersing unit 34 and into the breathing piece 36. FIGS. 17A and 17B illustrate the flow of a user's exhalations through the protective face covering 10. The user's exhalations flow, in order, out through the breathing piece 36, through the air dispersing unit 34 and out of the air dispersing unit through side ports 60, without passing through filter member 26. It is to be appreciated that the above-described flow paths for inhalations and exhalations are facilitated by the above-described structure of the nose and chin protection member, wherein the plurality of openings 31 in nose and chin protection member 30 are air conduits which extend from the front side of the nose and chin protection member to the back side, where each opening has a deflection member 33 such that a stream of air flowing from the front side to the back side impacts the deflection member as the stream of air flows from the front side to the back side.

It is contemplated that the protective face covering 10 of the present invention may be constructed from any suitable material. It should be noted, again, that the present invention covers those areas described an shown and does not extend beyond those areas to an appreciable degree. Thus, the present device can be worn independently of any other head covering, to provide protection (both physical and from the elements, dust, insects, and the like). Alternatively, the present device can be used to supplement the protection provided by many helmets that do not extend over the areas covered by the present device, and the present device does not need to be designed to attach to those existing helmets in order to be used by a user thereof. Moreover, the present invention may be used in a variety of other endeavors not discussed above, including use by medical personnel, sky divers, industrial and factory workers, painters, miners, welders, automobile body shop workers, oil field workers, farm workers, heavy equipment operators, winter sports enthusiasts, skate boarders, paintball participants, and hunters.

Having thus described the preferred embodiment of the invention, what is claimed as new and desired to be protected by Letters Patent includes the following:

What is claimed is:

1. An apparatus for providing protection to a user's face, namely the user's mouth, nose, chin, ears and jaw, the apparatus comprising, in an ordered arrangement from a position configured to be adjacent to the user's mouth and proceeding away from the user's face:

a breathing piece having an opening configured to fit over the mouth and nose of the user, the breathing piece further comprising a peripheral wall for sealing around the user's mouth and nose;

an air dispersing member having a perforated front wall disposed against the opening in the breathing piece;

a filter member having an inward facing side and outside facing side, the inward facing side disposed against the perforated front wall;

a nose and chin protection member fabricated from an impact resistant material, the nose and chin protection member having a back side and a front side, a plurality of openings extending from the back side to the front side, wherein the outside facing side of the filter member is disposed against the back side of the nose and chin protection member;

a mandibular-shaped outer member defined by a front piece and an integral left side member and an integral right side member, the mandibular-shaped outer member having an interior face and an exterior face, wherein the breathing piece, the air dispersing member, the filter member and the nose and chin protection member are encapsulated between the integral left side member and the integral right side member, wherein the nose and protection member comprises a plurality of air conduits extending from the front side to the back side, each air conduit having a deflection member configured such that a stream of air flowing from the front side to the back side impacts the deflection member as the stream of air flows from the front side to the back side, the stream of air thereafter accessible to the user by flowing through the filter member and through the perforated front wall to the user's mouth and nose, when the apparatus is worn by the user.

2. The apparatus of claim 1 further comprising a fastening unit having a first portion which attaches to the integral left side member of the mandibular-shaped outer member, the fastening unit having a second portion which attaches to the integral right side member of the mandibular-shaped outer member, wherein the fastening unit is configured to encircle a back portion of a head of the user.

3. The apparatus of claim 2 wherein the first portion comprises a left ear engagement surface and the second portion comprises a right ear engagement surface, the left ear engagement surface configured to seal around the user's left ear and reduce concussive impacts and the right ear engagement surface configured to seal around the user's right ear and reduce concussive impacts.

4. The apparatus of claim 1 further comprising a mesh member disposed between the nose and chin protection member and the mandibular-shaped outer member.

5. The apparatus of claim 1 wherein the peripheral wall of the breathing piece comprises a cushioning portion.

6. The apparatus of claim 1 wherein the mandibular-shaped outer member comprises a protective airway covering.

7. The apparatus of claim 4 wherein the mandibular-shaped outer member comprises a nasal opening adjacent to the mesh member.

8. The apparatus of claim 1 further comprising a communications system attached to the mandibular-shaped outer member, the communications system comprising a microphone and an ear piece.

9. The apparatus of claim 8 wherein the communications system further comprises a camera.

10. An apparatus for providing protection to a user's face, namely the user's mouth, nose, chin, ears and jaw, the apparatus comprising:

a mandibular-shaped outer member defined by a front piece and an integral left side member and an integral right side member, the mandibular-shaped outer member having an interior face and an exterior face; and a nose and chin protection member fabricated from an impact resistant material, the nose and chin protection member comprising an integral air filtering package, the nose and chin protection member attached to the mandibular-shaped outer member, the air filtering package comprising, in facing relation, a breathing piece having an opening defined by a peripheral wall configured to encircle the user's mouth and nose, an air dispersing unit having a perforated front wall disposed against the opening in the breathing piece, a filter member sandwiched between the perforated front wall on an inside face of the filter member and a back side of the nose and chin protection member, wherein, when the apparatus is being worn by the user, inhalations of the user flow, in order, through the mandibular-shaped outer member, the nose and chin protection member, the filter member, the air dispersing unit and into the breathing piece and where the user's exhalations flow, in order, out of the breathing piece, into the air dispersing unit and exiting the air dispersing unit through side vents of the air dispersing unit without the exhalations flowing through the filter member.

11. The apparatus of claim 10 further comprising a fastening unit having a first portion which attaches to the integral left side member of the mandibular-shaped outer member, the fastening unit having a second portion which attaches to the integral right side member of the mandibular-shaped outer member, wherein the fastening unit is configured to encircle a back portion of a head of the user.

12. The apparatus of claim 11 wherein the first portion comprises a left ear engagement surface and the second portion comprises a right ear engagement surface, the left ear engagement surface configured to seal around the user's left ear and reduce concussive impacts and the right ear engagement surface configured to seal around the user's right ear and reduce concussive impacts.

13. The apparatus of claim 10 further comprising a mesh member disposed between the nose and chin protection member and the mandibular-shaped outer member.

14. The apparatus of claim 10 wherein the peripheral wall of the breathing piece comprises a cushioning portion.

15. The apparatus of claim 10 wherein the mandibular-shaped outer member comprises a protective airway covering.

16. The apparatus of claim 10 further comprising a communications system attached to the mandibular-shaped outer member, the communications system comprising a microphone and an ear piece.

17. The apparatus of claim 16 wherein the communications system further comprises a camera.

18. An apparatus for providing protection to a user's face, namely the user's mouth, nose, chin, ears and jaw, the apparatus comprising:

a mandibular-shaped outer member defined by a front piece and an integral left side member and an integral right side member, the mandibular-shaped outer member having an interior face and an exterior face;

a left side ear member attached to the integral left side member and a right side ear member attached to the integral right side member, the left side ear member comprising a left ear engagement surface and the right side ear member comprising a right ear engagement surface, the left ear engagement surface configured to seal around the user's left ear and the right ear engagement surface configured to seal around the user's right ear;

a nose and chin protection member fabricated from an impact resistant material, the nose and chin protection member comprising an integral air filtering package, the nose and chin protection member attached to the mandibular-shaped outer member, the air filtering package comprising, in facing relation, a breathing piece having an opening defined by a peripheral wall configured to encircle the user's mouth and nose, an air dispersing unit having a perforated front wall disposed against the opening in the breathing piece, a filter member sandwiched between the perforated front wall on an inside face of the filter member and a support member on an outside face of the filter member, wherein, when the apparatus is being worn by the user, the user's exhalations flow, in order, out of the breathing piece, into the air dispersing unit and exiting the air dispersing unit through side vents of the air dispersing unit without the exhalations flowing through the filter member.

* * * * *